US006068343A

United States Patent [19]

Madore et al.

[11] Patent Number: 6,068,343

[45] Date of Patent: May 30, 2000

[54] SKATE WHEEL

[75] Inventors: Carl Madore, Portland; Christian Dibenedetto, Hillsboro, both of Oreg.

[73] Assignee: Nike, Inc., Beaverton, Oreg.

[21] Appl. No.: 09/008,426

[22] Filed: Jan. 16, 1998

[51] Int. Cl.[7] ..... A63C 17/22

[52] U.S. Cl. ..... 301/5.3; 152/323; 152/165; 152/500

[58] Field of Search ..... 152/DIG. 18, 500, 152/501, 385, 379.3, 380, 323, 329, 165; 280/11.22; 301/5.3, 105.1, 110.6; 264/277

[56] References Cited

U.S. PATENT DOCUMENTS

| | | | |
|---|---|---|---|
| 312,733 | 2/1885 | Koch | 16/45 |
| 322,611 | 7/1885 | Jones et al. | 301/5.3 |
| 565,795 | 8/1896 | Reach . | |
| 979,169 | 12/1910 | Kennedy . | |
| 988,533 | 4/1911 | Zverina . | |
| 1,035,424 | 8/1912 | Rice . | |
| 1,539,445 | 5/1925 | Buuren . | |
| 1,584,778 | 5/1926 | Kingsbury | 301/63.1 |
| 2,168,820 | 8/1939 | Edstrom . | |
| 2,241,685 | 5/1941 | Ware . | |
| 2,262,714 | 11/1941 | Ware . | |
| 3,877,710 | 4/1975 | Nyitrai . | |
| 5,028,058 | 7/1991 | Olson . | |
| 5,048,848 | 9/1991 | Olson et al. . | |
| 5,129,709 | 7/1992 | Klamer . | |
| 5,190,301 | 3/1993 | Malewicz . | |
| 5,308,152 | 5/1994 | Ho . | |
| 5,310,250 | 5/1994 | Gonsior . | |
| 5,320,418 | 6/1994 | Chen . | |
| 5,346,231 | 9/1994 | Ho . | |
| 5,460,433 | 10/1995 | Hawley . | |
| 5,470,086 | 11/1995 | Peterson et al. . | |
| 5,524,913 | 6/1996 | Kubeck . | |
| 5,564,790 | 10/1996 | Lekavich . | |
| 5,853,225 | 12/1998 | Huang | 301/5.3 |

FOREIGN PATENT DOCUMENTS

| | | | |
|---|---|---|---|
| 393869 | 1/1909 | France . | |
| 4067 | 6/1894 | United Kingdom . | |
| 3372 | 2/1897 | United Kingdom . | |
| 346476 | 4/1931 | United Kingdom . | |
| WO 96/18513 | 6/1996 | WIPO | 5/1 |

OTHER PUBLICATIONS

Oxygen®, Get Outta Our Way!, dated 1997.
Hyper Wheels, dated 1996.
Global Skate, Industry Innovations, dated Feb./Mar. 1997.

*Primary Examiner*—Jeff H. Aftergut
*Assistant Examiner*—Gladys Piazza
*Attorney, Agent, or Firm*—Banner & Witcoff, Ltd.

[57] ABSTRACT

An in-line skate wheel including a hub that positions and supports a bladder generally about the center line of the hub. The wheel hub comprises an inner surface forming a bore for receiving a wheel axle, an outer circumferential surface spaced from the inner surface and first and second edges. The hub also comprises a center line evenly spaced from the first and second edges of the outer surface. Contoured positioning tabs are located along the circumference of the outer surface and are alternately spaced on opposite sides of the center line to receive and retain the bladder therebetween in order to position it about the center line and support it during the use of the wheel.

38 Claims, 7 Drawing Sheets

SKATE WHEEL

REFERENCE TO RELATED APPLICATION

This application is related to the U.S. Pat. application of Christian DiBenedetto and Daniel Richards entitled "SKATE WHEEL AND METHOD OF APPLYING INDICIA TO A PORTION OF A SKATE WHEEL" filed concurrently herewith and which is herein incorporated by reference.

FIELD OF THE INVENTION

The present invention relates to an in-line skate wheel with a hub for supporting and positioning an internal bladder.

BACKGROUND OF THE INVENTION

In-line skates include a series of wheels that are longitudinally arranged one behind the other along the length of a frame. These wheels normally rotate in a common, vertical plane creating an experience that is similar to ice skating. In-line skating has experienced a considerable increase in its popularity over the last decade. In recent years, in-line skating has become an increasingly popular activity. This is in part due to its combining the excitement and challenge of ice skating with the freedoms of running. In-line skates enable a user to access a variety of smooth and rough indoor and outdoor surfaces including composite rubber floors, concrete and asphalt. In-line skates also offer a variety of wheel types to match the different surfaces and different types of skating.

Conventional in-line skate wheels are either solid or pneumatic. Solid wheels are usually very hard and formed of rubber, plastic or other appropriate materials. Skates using solid wheels often cause discomfort to the skater, particularly when traveling over rough surfaces like asphalt or concrete that can cause road chatter or other types of high frequency vibrations. These hard wheels transmit vibrations directly to the feet of the skater, often times causing discomfort that persists long after skating has concluded.

When compared to solid skate wheels, pneumatic skate wheels provide skaters with a more comfortable ride. Pneumatic skate wheels include a bladder or fluid receiving area that dampens vibrations created during skating. These wheels also give the skater the option of using a softer or harder tire depending on the type of skating to be done. Pneumatic skate wheels are lighter than solid wheels of the same size, as a result, they can significantly reduce the overall weight of a skate, especially, when the skate requires four or more wheels.

Traditional pneumatic wheels have been known to fail under certain conditions. For instance, the centrifugal force generated at high speeds can deform a pneumatic wheel if its internal bladder or tire lacks adequate lateral support. The tires of poorly bonded pneumatic skate wheels may separate from their hubs and cause injury to a skater when used on surfaces or in a manner that causes strong, jarring shocks or constant, intense vibrations. These shocks and vibrations can be caused by landing on the skating surface at various angles, abrupt stopping, abrupt lateral movements, or dragging a wheel or a rack of wheels along the ground. Traditional pneumatic wheels are also difficult and expensive to manufacture because they require a sliding tool to form the outer circumferential surface of the hub. Moreover, properly locating a bladder on a prior art molded hub can be a very difficult and time consuming procedure.

U.S. Pat. No. 5,630,891, to Peterson et al., discloses a pneumatic in-line skate wheel having a tire body and a central hub constructed of a polyurethane material. The hub includes a pair of radially projecting flanges forming a drop center. Angularly shaped stand off ribs, defining spokes, radiate outwardly from the drop center and a pair of positioning nubs is located on support tips defined by the joint between cooperating stand off ribs. The bladder is placed directly on the hub and rests on the support tips between a pair of positioning nubs. The positioning nubs do not provide lateral support to the side walls of the bladder and do not laterally urge the bladder into alignment with the centerline of the hub when the tire material is being introduced. The radially projecting flanges prevent the tire material from flowing around and along the sides of the support tips.

U.S. Pat. No. 979,169, to Kennedy, discloses a pneumatic in-line skate wheel. The wheel includes a pneumatic bladder surrounded by an outer tire casing that is secured to the hub by plurality of flanges extending outwardly from the hub body. The hub does not have a plurality of tabs extending from its outer surface for positioning and aligning the bladder during the pouring of the tire material.

U.S. Pat. No. 988,533, to Zverina, and U.K. Patent No. 3,372, to Wyatt, disclose pneumatic skate wheels for skates having an internal bladder surrounded by a tire material. The bladder rests in a groove on the outer surface of a hub and is held in place by the tire material being locked into the hub. The hub does not include a plurality of tabs that position the bladder above its outer surface and in alignment with its centerline so that a tire material can be poured completely around the bladder.

A decided need in the art exists for an in-line skate wheel with a hub that easily receives and centers a pneumatic tire bladder. There is also a decided need in the art for an in-line skate wheel hub that provides adequate support to a pneumatic tire bladder while being easy and inexpensive to manufacture.

It is an object of the present invention to overcome the disadvantages of the prior art inline skate wheels, particularly those of the prior art pneumatic in-line skate wheels.

SUMMARY OF THE INVENTION

An in-line skate wheel according to the present invention comprises a wheel hub having an inner surface, an outer circumferential surface and a plurality of positioning tabs. The inner surface forms a bore for receiving a wheel axle. The outer circumferential surface is spaced from the inner surface and has a center line evenly spaced between its first and second edges. The plurality of positioning tabs are arranged along the circumference of the outer surface such that at least two successive tabs are located on opposite sides of the center line. A bladder is received between and positioned by the positioning tabs so that it is out of contact with the outer circumferential surface. The wheel also comprises a tire member completely surrounding the bladder and bonded thereto. The tire member also bonds with the outer circumferential surface and positioning tabs of the hub to provide torsional stability.

In an embodiment of the present invention, the positioning tabs have inner and outer surfaces with at least the inner surface being contoured to receive and position a bladder generally in-line with the center line of the hub. At least one positioning tab comprises first and second spaced supports and a bridging member. An area between the two spaced supports and the bridging member is open so that the material used to form the tire flows therethrough and mechanically locks with the tabs while chemically bonding with the bladder. The spaced supports include contoured surfaces proximate the center line. Each surface includes a first concave portion between a top of the support and the outer circumferential surface, a second concave portion between the first concave portion and the outer circumferential surface and a convex portion between the first and second concave portions.

In another preferred embodiment, each of the positioning tabs has a leading edge and a trailing edge with the tabs being curved in the direction of the trailing edge. At least one of these tabs includes a contoured inside surface that is proximate the center line of the hub for positioning a bladder thereabout. The contoured inside surface includes a concave portion positioned between a top edge of the tab and the outer circumferential surface, a vertical side wall between the concave portion and the outer circumferential surface and a step groove between the vertical side wall and the concave portion.

A wheel hub according to the present invention includes an inner axial bore surface and an outer circumferential surface having first and second edges spaced from the inner surface. The wheel hub also includes a center line evenly spaced from the first and second edges. Positioning tabs are located along the circumference of the outer surface and are alternately spaced on opposite sides of the center line. The tabs include means for locating and supporting a bladder generally in-line with the center line of the hub.

As discussed above, traditional skate wheels having poor urethane, weak cores or bad bonding can be unstable and have poor torsional rigidity. The skate wheel according to the present invention has a hub including a plurality of positioning tabs extending from the hub within the tire member to provide torsional rigidity to the wheel. The interlocking of the hub and bladder also create torsional rigidity within the wheel for increased stability and safety when compared to prior art skate wheels.

DETAILED DESCRIPTION OF THE PREFERRED EMBODIMENTS

Figure 1:
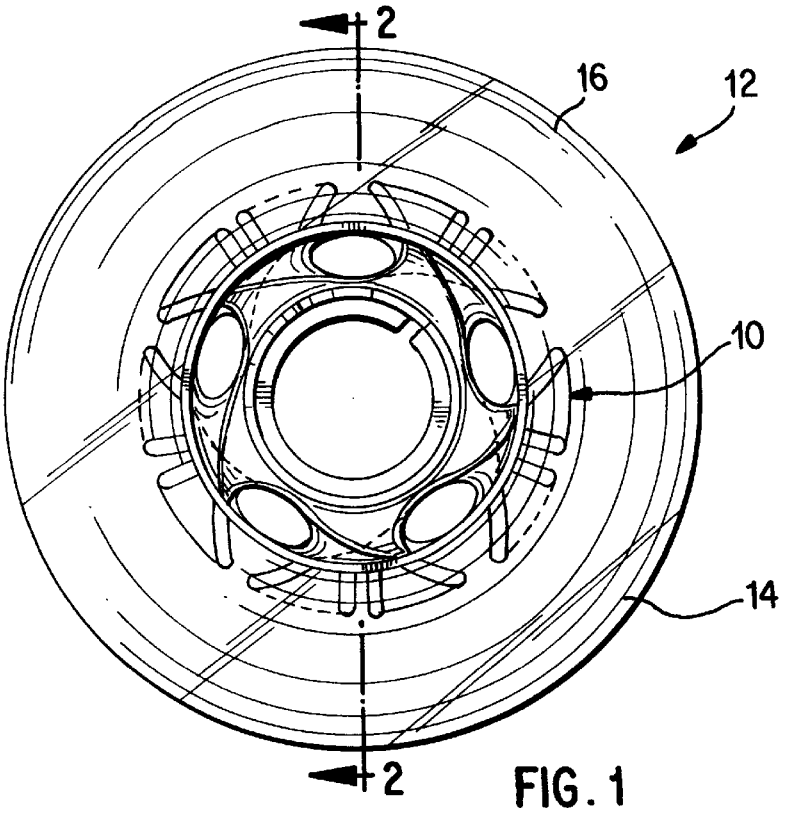
FIG. 1 is a front elevational view of a wheel having a hub and a bladder according to a preferred embodiment of the present invention.
Figure 2:
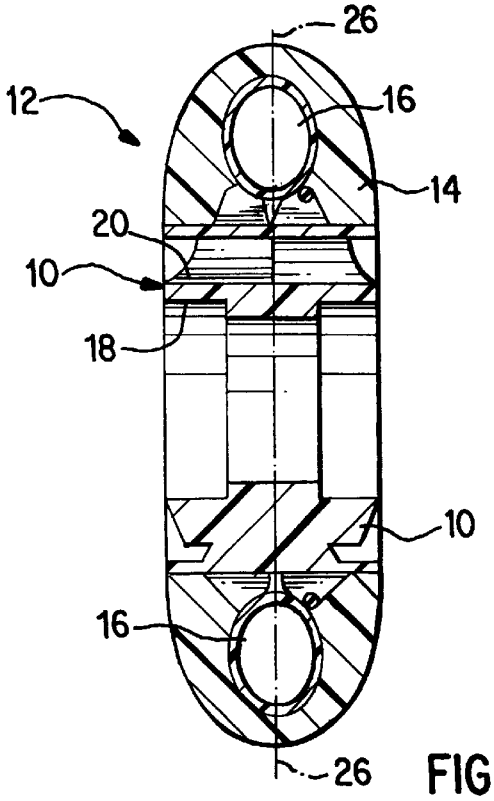
FIG. 2 is a cross-sectional view of the wheel taken along the line 2—2 of FIG. 1.
Figure 3:
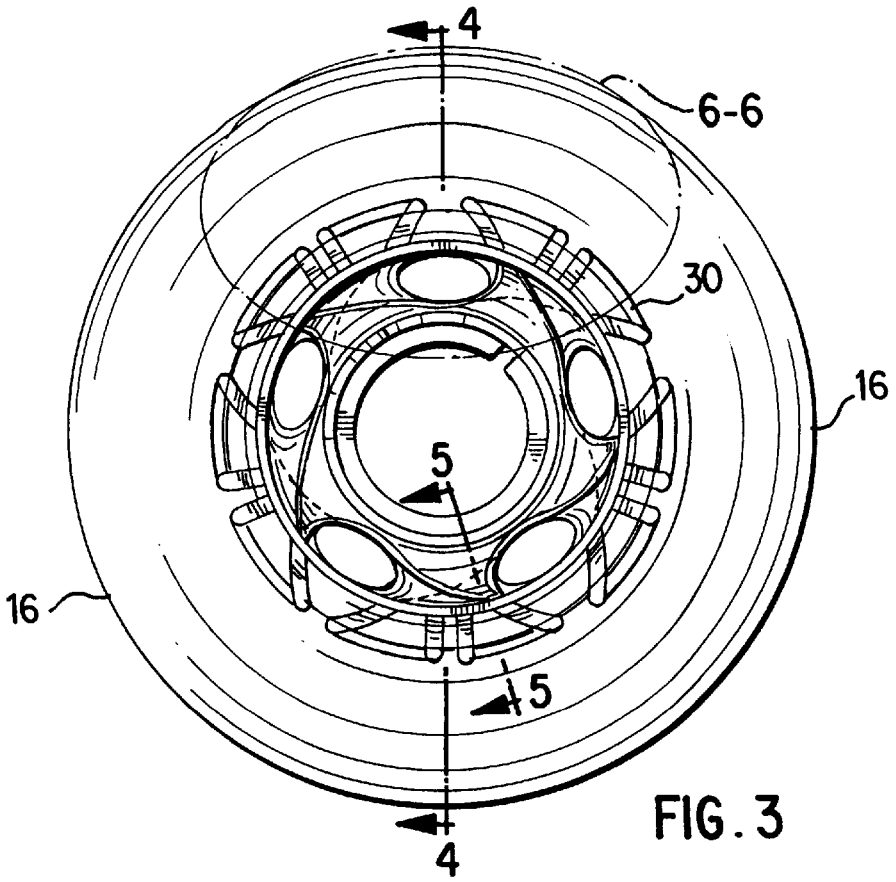
FIG. 3 is a front elevational view of the wheel hub and bladder according to the embodiment of FIG. 1 without the tire.
Figure 4:
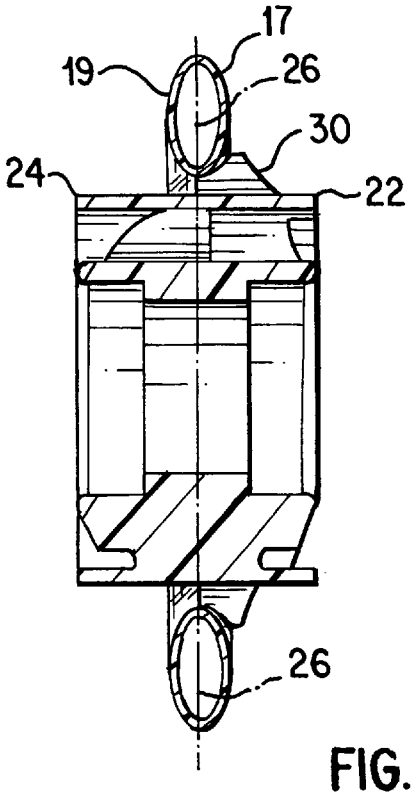
FIG. 4 is a cross-sectional view of the wheel hub and bladder taken along the line 4—4 of FIG. 3.
Figure 5:
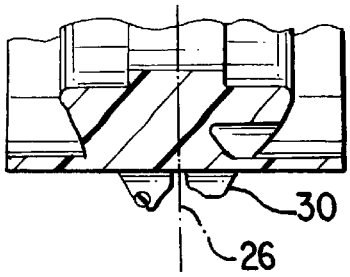
FIG. 5 is a cross-sectional view of the wheel hub taken along the line 5—5 of FIG. 3.

The in-line skate wheel 12 according to the present invention includes an outer tire member 14 formed of an annulus of resilient, yieldable urethane material molded about a wheel hub 10. Encapsulated within the tire 14 is a centrally spaced bladder 16. Bladder 16 is manufactured using known techniques, such as those described in U.S. Pat. Nos. 4,183,156 and 4,219,945 to Marion F. Rudy, the contents of which are hereby expressly incorporated by reference.

In one preferred embodiment, bladder 16 is formed of two annular sheets of a thermoplastic elastomeric material 17, 19, having a thickness of 0.030 to 0.060 mm. Materials used to form bladder 16 include polyester polyurethane, polyether polyurethane or the additional suitable materials identified in the '156 and '945 patents. Among the numerous thermoplastic urethanes which are particularly useful in forming the film layers are urethanes such as Pellethane™, (a trademarked product of the Dow Chemical Company of Midland, Mich.), Elastollan® (a registered trademark of the BASF Corporation) and ESTANE® (a registered trademark of the B. F. Goodrich Co.), all of which are either ester or ether based and have proven to be particularly useful. Still other thermoplastic urethanes based on polyesters, polyethers, polycaprolactone and polycarbonate macrogels can be employed. Sheets 17 and 19 are connected along an inner circumferential flange 21 and an outer circumferential flange 29, by a conventional technique such as welding.

Figure 7:
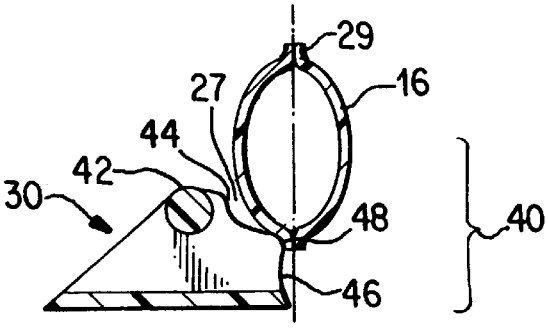
FIG. 7 is a cross-sectional view of the wheel hub and bladder taken along the line 7—7 of FIG. 6 before the introduction of a tire material.

Bladder 16 is inflated under pressure with a supportive, cushioning gaseous fluid, for example, sulfur hexafluoride ("supergas"), air, or one of the other suitable gases which are identified in the '156 and '945 patents, such as: hexafluoroethane; perfluoropropane; perfluorobutane; perfluoropentane; perfluorohexane; perfluoroheptane; octafluorocyclobutane; perfluorocyclobutane; hexafluoropropylene; tetrafluoromethane; monochloropentafluoroethane; 1, 2-dichlorotetrafluroethane; 1, 1, 2-trichloro-1, 2, 2 trifluoroethane; chlorotrifluoroethylene; bromotrifluoromethane; and monochlorotrifluoromethane. These gases may all be termed "supergases". In a preferred embodiment of the present invention, the bladder is inflated with sulfur hexafluoride to provide a consistent and enduring inflation pressure. When filled, bladder 16 takes on a configuration where sheets 17 and 19 balloon away from one another, such as shown in FIG. 7. Preferably, bladder 16 is filled to a pressure in the range of 0 to 60 psi with the preferred range being between 25 psi to 35 psi prior to introducing the material of tire 14.

Hub 10 has an inner surface 18 for receiving the bearings and axle for in-line skate wheel 12. The inner surface 18 is configured to receive the outer races of bearing assemblies commonly used with in-line skate wheels. Hub 10 also includes an outer circumferential surface 20 spaced from the inner surface 18 and having first and second side edges 22, 24 spaced on opposite sides a center line 26. A plurality of positioning tabs 30 are located along the circumferential outer surface 20 and are configured for positioning and supporting the bladder 16 to ensure its proper placement within wheel 12, such that the bladder including its inner flange 21 is completely out of contact with outer circumferential surface 20. Positioning tabs 30 are alternately spaced so that at least two successive tabs are located on opposite sides of center line 26. Preferably, tabs 30 are positioned so that each circumferentially successive tab is located on the opposite side of center line 26 from the previous tab 30 so that adjacent tabs 30 do not overlap one another in the circumferential direction. Alternate spacing of the tabs 30 allows the production mold to be a non-sliding tool, as discussed below. Moreover, alternate spacing facilitates the placing of bladder 16 on hub 10 by allowing the bladder to flex between the gaps in the tab arrangement, thereby making it easier for the bladder to be snapped over the alternating tabs 30 and properly positioned on hub 10. Tabs 30 also allow a tire material such as urethane to flow directly to and around the bladder during manufacture so that a chemical bond between the bladder and the tire material is formed. The number of supporting tabs can vary depending on the size of the hub and the bladder.

Each tab 30 includes first and second supports 32, 34 and a bridging member 36 connected therebetween. Supports 32, 34 extend generally radially away from circumferential outer surface 20, with support 32 extending away at an acute angle to form an overhang under which the tire material flows and around which it bonds. A passageway 38 allows the tire material to flow under bridging member 36 and between supports 32, 34 to form a mechanical lock with hub 10.

Hub 10 is positioned within a mold and mounted on a spindle. After securing the hub and mold on the spindle, liquid urethane tire material is introduced into the mold to form the tire member. Preferably, a portion of the mold is open so that the liquid urethane can be poured into it. It is also possible to introduce the urethane into the mold by injection. After the urethane cures, hub 10 is finished by removing any part of it that extends laterally beyond the sides of wheel 12 or a predetermined distance away from wheel 12.

Figure 6:
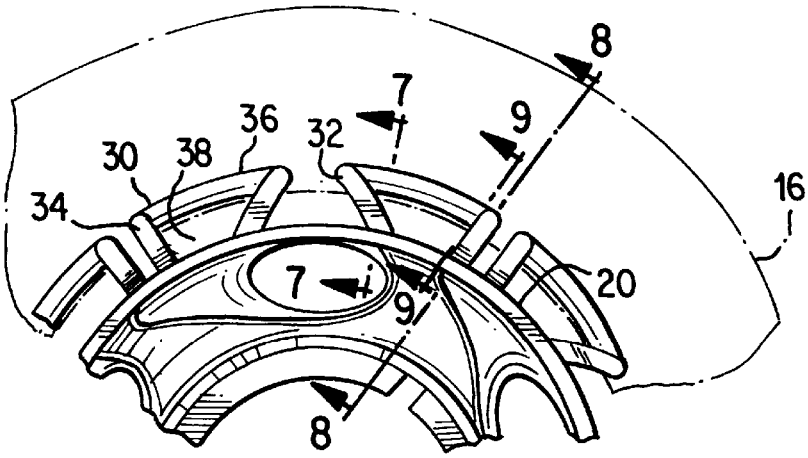
FIG. 6 is an enlarged view of a portion of the wheel hub shown within the oval 6—6 of FIG. 3.
Figure 8:
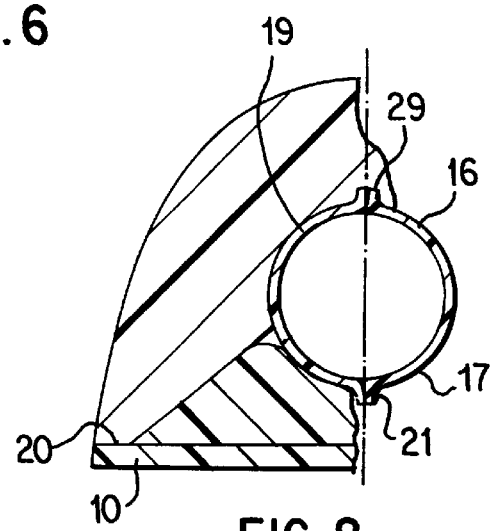
FIG. 8 is an enlarged partial cross section of the wheel taken along the line 8—8 of FIG. 6 after the introduction of a tire material.
Figure 9:
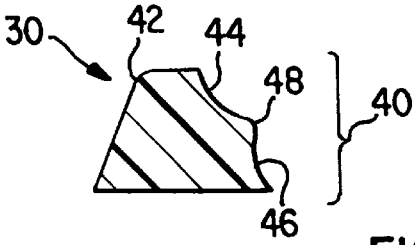
FIG. 9 is a cross section of the wheel hub taken along the line 9—9 of FIG. 6 with the bladder removed.
Figure 11A:
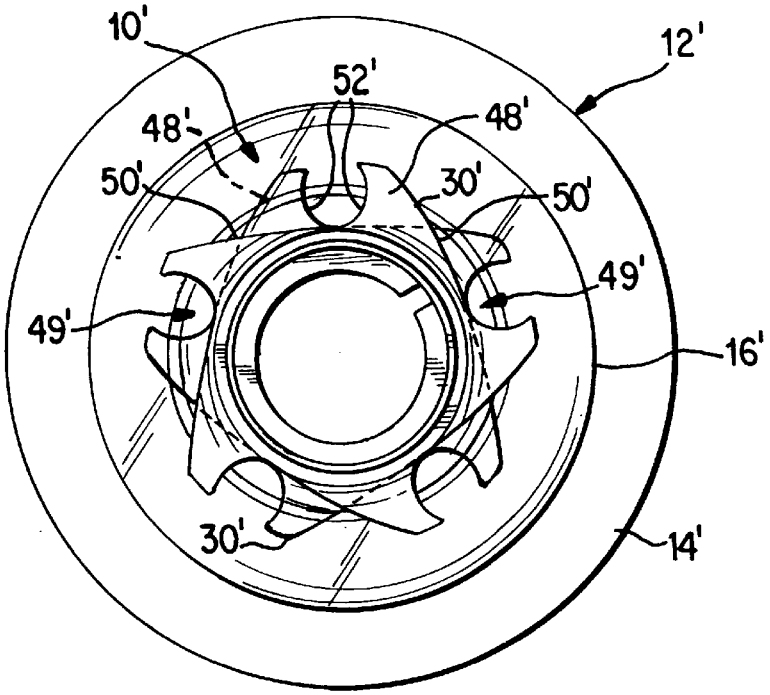
FIG. 11A is a front elevational view of a wheel including a wheel hub and bladder according to another preferred embodiment of the present invention.
Figure 10:
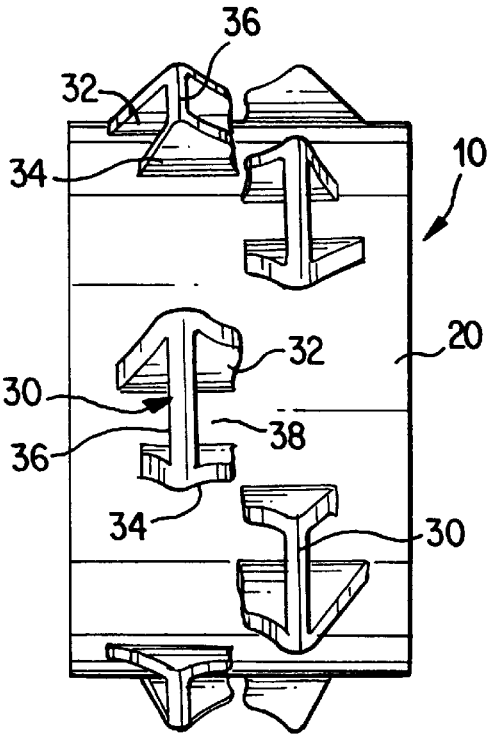
FIG. 10 is a side view of the wheel hub according to the preferred embodiment of the present invention illustrated in FIG. 1.
Figure 11B:
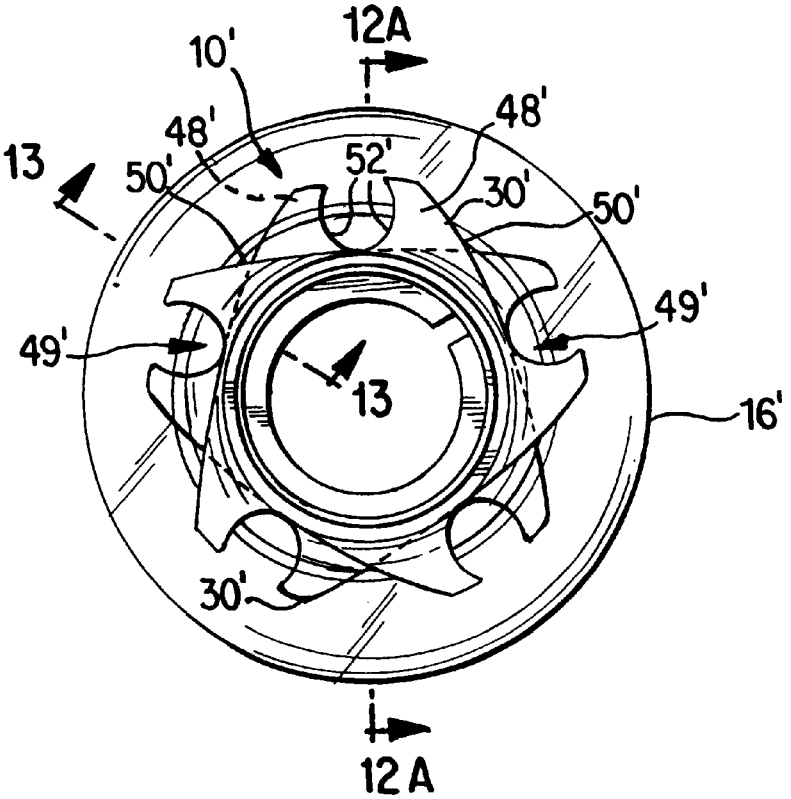
FIG. 11B is a front elevational view of the wheel hub and bladder according to the embodiment of FIG. 11A.

Supports 32, 34 each have an inside contoured surface 40 for positioning and supporting bladder 16 generally in-line with center line 26 and above outer circumferential surface 20. The positioning of bladder 16 and its inner flange 21 above and out of contact with outer circumferential surface 20 is best seen in FIG. 6. The inside contoured surfaces 40 are proximate to and face center line 26. Each surface has a first concave portion 44 located between an upper end 42 of the support and the outer circumferential surface 20. This concave portion 44 includes a radius of curvature that provides sufficient space for the bladder to expand into when it is heated during the introduction of the tire material. FIG. 7 illustrates bladder 16 in a fluid filled condition, prior to the introduction of the tire material. A gap or space 27 remains between first concave portion 44 of support surface 40 and bladder 16. During manufacture, tire material in a hot liquid form is poured around hub 10 and bladder 16. This causes bladder 16 to expand to the condition shown in FIG. 8. The radius of curvature for the concave and convex portions of tabs 30 is dependent upon the size of the bladder. They are sized to accept and support the inflated bladder 16 before the tire material is introduced. They are also sized to receive bladder 16 after it has been expanded by the tire material. The radii vary with the curve of the bladder so they will match its shape when fully expanded. The range of the radii or curvature is between 0.02 inch and 0.1 inch. Concave portion 44 allows the tire material to flow between the bladder and the tab 30 to form a chemical bond between concave portion 44 and the expanded bladder 16. A second concave portion 46 is located along a step between the first concave portion 44 and the outer circumferential surface 20. The spacing of the step from the outer circumferential surface 20 and the radius of curvature of the second concave portion 46 support the bladder above outer circumferential surface 20 so that the tire material flows under the bladder and between the bladder and the tab 30 to chemically bond with the bladder and mechanically bond with the tab 30 and the entire outer circumferential surface 20. A convex portion 48 is between the first concave portion 44 and the second concave portion 46 for spacing the bladder above the outer circumferential surface 20. Portion 48 is shaped to allow tire material to flow between itself and bladder 16 so that the tire material can bond with a portion of the bladder just above flange 21. The shape also aids in the release of air bubbles when the urethane tire material is injected or poured.

Another preferred embodiment of the present invention, illustrated in FIGS. 11 to 14, includes a wheel hub 10' for use with an in-line skate wheel 12' having an outer tire member 14' formed of an annulus of resilient, yieldable urethane material molded about hub 10'. The hub 10' has an inner circumferential surface 18', similar to the inner surface 18 of wheel hub 10, for receiving a bearing and axle of an in-line skate wheel 12'. Hub 10' also includes an outer circumferential surface 20' having a plurality of positioning tabs 30' alternately spaced on opposite sides of a center line 26' for positioning and supporting a bladder 16' which differs from bladder 16 in only its size. The alternate spacing simplifies the placement of the bladder 16' on the hub 10' by making it easier for the bladder 16' to be snapped over the alternating tabs 30' as discussed above with respect to tabs 30. Moreover, tabs 30' provide for a tire material such as urethane to flow directly to and around the bladder during manufacture so that a chemical bond is formed between the tire material and the bladder 16' and a mechanical bond is formed between the tire material and the tabs 30'.

Figure 12B:
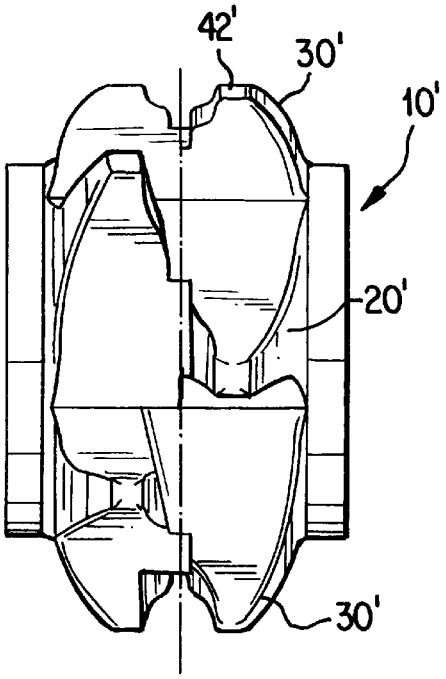
FIG. 12B is a side view of the wheel hub according to the preferred embodiment of the present invention illustrated in FIG. 11A.
Figure 12A:
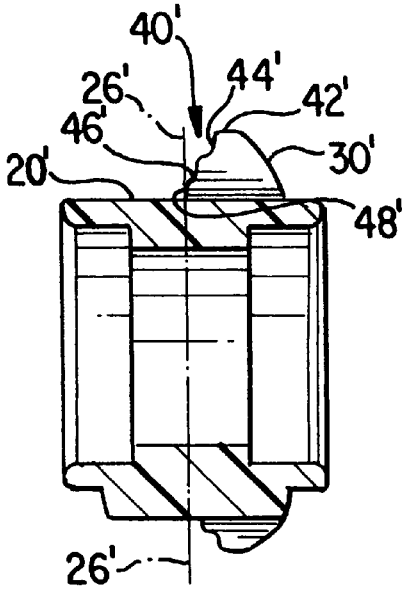
FIG. 12A is a cross-sectional view of the wheel hub taken along the line 12A—12A of FIG. 11B.
Figure 13:
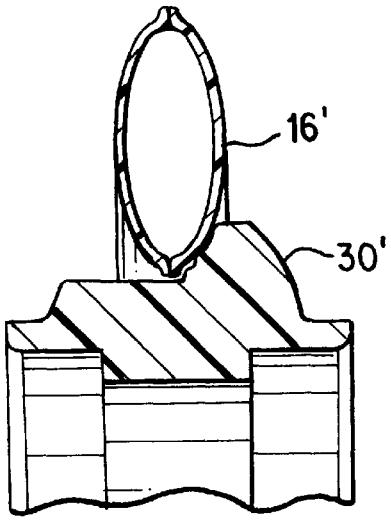
FIG. 13 is a cross-sectional view of the wheel hub and bladder taken along the line 13—13 of FIG. 11B.

Each tab 30' has a fin-like vertical profile in a plane parallel to a plane containing the center line 26' and perpendicular to a plane containing the outer circumferential surface 20'. As seen in FIG. 12A, the tabs 30' are curved in a first circumferential direction on one side of the center line 26' and in the opposite circumferential direction on the other side of the center line 26'. A channel-like opening 49' is formed between adjacent oppositely curved tabs 30' so that the tire material and any gas bubbles produced during manufacturing can flow under the bladder and between the tabs when bladder 16' is supported by tabs 30'. The introduced tire material flows through channel-like openings 49' and under the bladder 16' to surround each tab 30' and form a mechanical lock between the tire 14' and the hub 10'.

Figure 14:
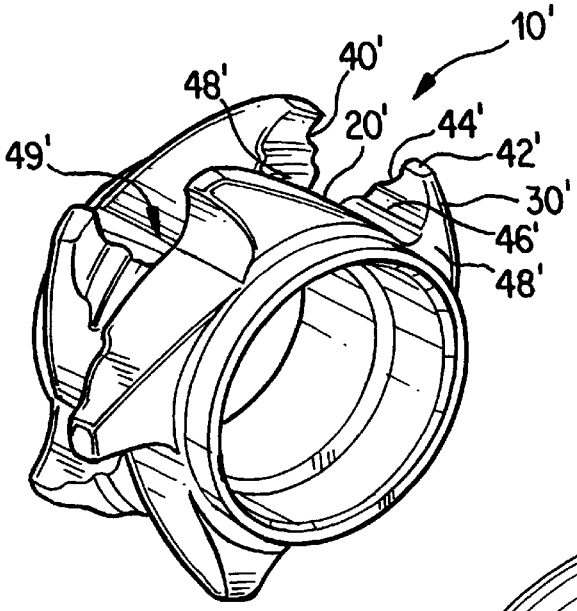
FIG. 14 is a perspective view of the wheel hub of FIG. 11A.
Figure 17:
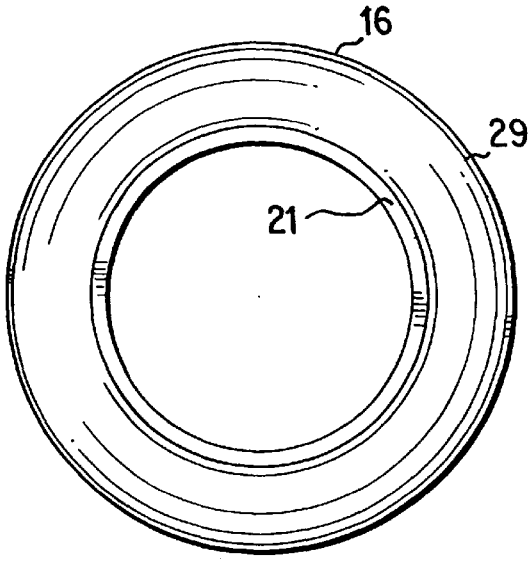
FIG. 17 is a front elevational view of a bladder according to the present invention.

Each tab 30' has an inside contoured surface 40' for positioning and supporting the bladder 16' generally in-line with the center line 26'. The inside contoured surfaces 40' are proximate to and face center line 26' as in the first embodiment. Each surface 40' has a first concave portion 44' located between its upper end 42' and the outer circumferential surface 20'. Concave portion 44' has a radius of curvature large enough that the bladder can expand into it when it is heated during the introduction of the tire material. The concave portion is also large enough for the tire material to flow between the expanded bladder and the tab 30' as discussed above with respect to concave portion 44. The radii of curvature for the convex and concave portions of tabs 30' are between 0.02 inch and 0.12 inch. A vertical side wall 48' is located between the first concave portion 44' and the outer circumferential surface 20' on each tab 30'. As best seen in FIGS. 12A and 14, side wall 48' is curved or tapered from a leading edge 50' to a trailing edge 52' along an inner surface of tab 30'. A step groove 46' is between the first concave portion 44' and the vertical side wall 48' for retaining the bladder above the outer surface of the hub. Gaps 49, grooves 46' and the spacing of bladder 16' above surface 20' provide pathways for the tire material and bubbles, created during the introduction of the tire material, to flow around and under bladder 16'.

For each wheel, the contour of each inside surface locates the bladder and prevents it from twisting during manufacturing to ensure the proper placement of the bladder in the finished product. The convex portion of tab 30 and the step of tab 30' position their respective bladders by urging them in the direction of the center line of their respective hubs while suspending them above the outer circumferential surface so that the tire material can flow under each bladder and fill the area between the bladder and the outer circumferential surface. The contours also permit the tire material to flow into and fill the areas between the bladder and each of the concave portions so the tire material substantially encapsulates the bladder to protect it from the wear that is normally experienced by the external surfaces of an in-line skate wheel.

The hubs 10, 10' are formed of an integrally molded rigid polyurethane material such as ESTALOC, available from UNIROYAL. Other known materials that can be used for hub 10 include nylons including carbon and/or glass filled nylons; polycarbonites; gas filled composites; and regrind materials such as chopped fibers. The materials used to form the hub provide a strong mechanical bond between the hub and the tire material without the use of extraneous bonding agents such as epoxies or glues. Such a bond results in a strong, integrally formed wheel.

Figure 15:
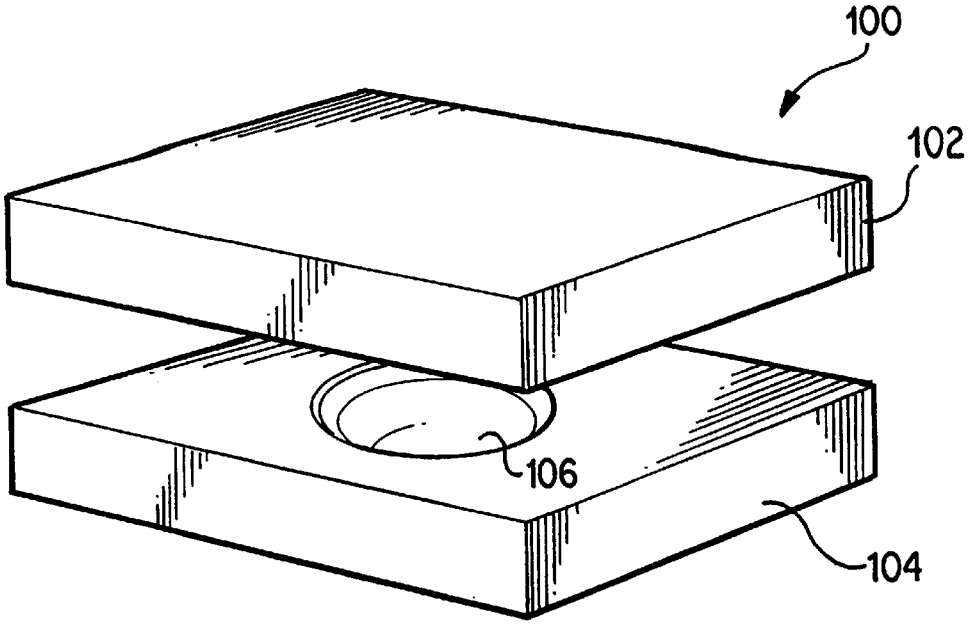
FIG. 15 is a view of the two part mold for forming a hub according to the present invention.
Figure 16:
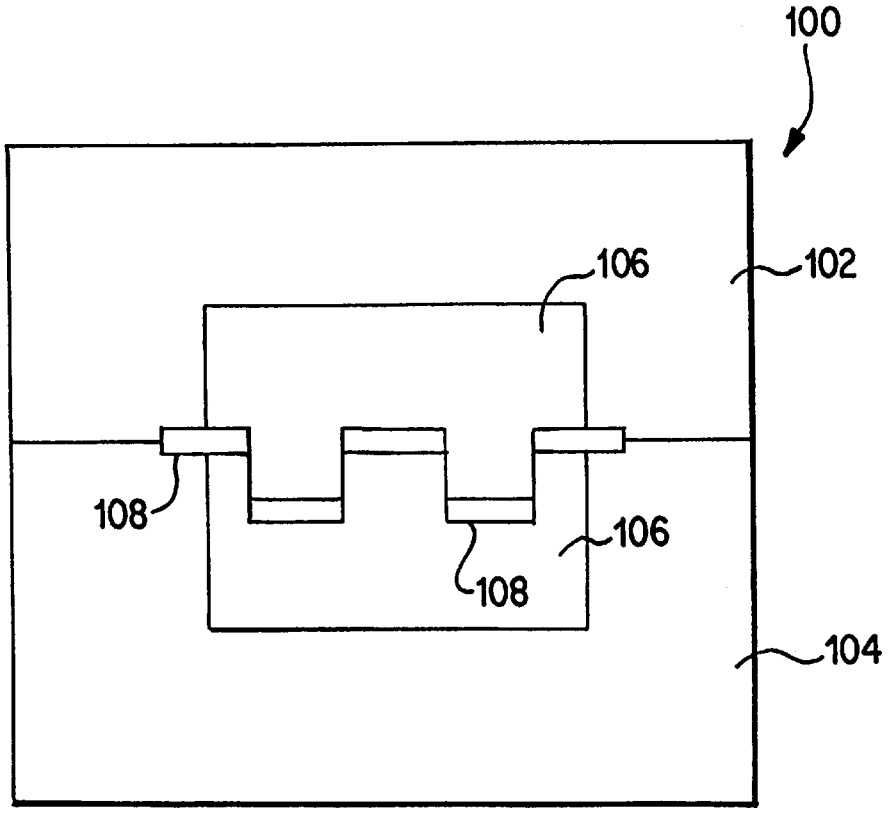
FIG. 16 is a cross section of the two part mold of FIG. 16.

The method of forming the wheel hub according to the present invention includes providing a two part mold 100 having cooperating elements 102, 104 as shown in FIGS. 15 and 16. The cooperating elements 102, 104 each have at least one internal cavity 106 for forming the outer circumferential surface of the hub and a plurality of tab forming members 108. The internal cavity 106 and tab forming members 108 are shaped to produce the hub embodiments discussed above. The material used to form the hub, such as ESTALOC, is introduced into the mold 100 by injection, pouring, or other well known manners of introducing a material into a mold. After the thermoplastic has filled in the mold cavity, the cooperating elements 102, 104 are secured together and the material is cured. When curing has been completed and the hub has been cooled, the cooperating elements 102, 104 are separated and any excess hub material is removed from the hub so the pathways for the tire material and gas bubbles are open.

Other members such as concentric sheets of elastomeric materials, such as those discussed above, having colors or printing could be used in addition to or in place of the bladder. These sheets are positioned about hub 10 or 10' in the same manner as the bladders.

Numerous characteristics, advantages and embodiments of the invention have been described in detail in the foregoing description with reference to the accompanying drawings. However, the disclosure is illustrative only and the invention is not limited to the illustrated embodiments. Various changes and modifications may be effected therein by one skilled in the art without departing from the scope or spirit of the invention.

What is claimed is:

1. An in-line skate wheel, comprising:

a bladder:

a hub having an inner surface, an outer circumferential surface and a plurality of positioning tabs;

said inner surface forming a bore for receiving a wheel axle;

said outer circumferential surface being spaced from said inner surface and having first and second edges and a center line evenly spaced from said first and second edges;

said plurality of positioning tabs being located along the circumference of said outer circumferential surface and alternately spaced on opposite sides of said center line such that at least two successive tabs are located on opposite sides of said center line, each tab including an inner side wall that is shaped to fit an outer surface of the bladder;

the bladder being received between and positioned by said positioning tabs out of contact with said outer circumferential surface; and a tire member completely surrounding said bladder and bonded to said bladder, and to said outer circumferential surface and positioning tabs of said hub by being molded thereto.

2. The in-line skate wheel of claim 1 wherein at least one of said plurality of positioning tabs comprises first and second spaced supports and a bridging member extending between said supports.

3. The in-line skate wheel of claim 2 wherein an opening is formed by said bridging member and said first and second spaced supports.

4. The in-line skate wheel of claim 1 wherein said plurality of positioning tabs each comprise first and second spaced supports, one of said supports including said inner side wall shaped to fit an outer surface of the bladder, and a bridging member extending between said supports.

5. The in-line skate wheel of claim 2 wherein each said tab includes another inner side wall shaped to fit an outer surface of the bladder; each of the supports includes one of the inner side walls; and each said inner side wall has a contoured inside surface proximate said center line for positioning said bladder generally in-line with said center line.

6. The in-line skate wheel of claim 5 wherein said contoured inside surface of each said support includes a first concave portion between a top of said support and a position spaced from said outer circumferential surface.

7. The in-line skate wheel of claim 6 wherein said contoured inside surface of each said support leaves a gap between said bladder and said contoured inside surface prior to the molding of said tire member to said hub and bladder, and said bladder is contoured to said contoured inside surface when said tire member is molded to said hub and said bladder.

8. The in-line skate wheel of claim 6 further comprising a second concave portion between said first concave portion and said outer circumferential surface.

9. The in-line skate wheel of claim 8 further comprising a convex portion located between said first and second concave portions.

10. The in-line skate wheel of claim 1 wherein said bladder includes a gas at greater than ambient pressure.

11. The in-line skate wheel of claim 1 wherein said plurality of positioning tabs have a leading edge and a trailing edge, and said tabs are curved in the direction of said trailing edge.

12. The in-line skate wheel of claim 11 wherein said plurality of positioning tabs have a fin-like cross section in a plane parallel to said center line.

13. The in-line skate wheel of claim 1 wherein said inner side wall includes a contoured inside surface proximate said center line for positioning the bladder about said center line.

14. The in-line skate wheel of claim 13 wherein said plurality of positioning tabs each include another inner side wall, both of the inner side walls of one tab having a contoured inside surface proximate said center line for positioning the bladder about said center line.

15. The in-line skate wheel of claim 14 wherein each contoured inside surface of said tabs leaves a gap between said bladder and said contoured inside surface prior to the molding of said tire member to said hub and bladder, and said bladder is contoured to and bonded to said contoured inside surface after said tire member is molded to said hub and said bladder.

16. The in-line skate wheel of claim 15 wherein each contoured inside surface includes a concave portion positioned between a top edge of said positioning tab and said outer surface.

17. The in-line skater wheel of claim 16 wherein each contoured inside surface further includes a vertical side wall between said concave portion and said outer circumferential surface.

18. The in-line skate wheel of claim 17 wherein each contoured inside surface further includes a step groove between said vertical side wall and said concave portion.

19. The in-line skate wheel of claim 18 wherein each of said plurality of positioning tabs has a leading edge and a trailing edge and said vertical side walls taper from said leading edge to said trailing edge.

20. The in-line skate wheel of claim 1 wherein said hub is comprised of a thermoplastic material.

21. A wheel hub comprising:

an inner axial bore surface;

an outer circumferential surface spaced from said inner surface and having first and second edges and a center line evenly spaced from said first and second edges; and a plurality of positioning tabs located along the circumference of said outer surface and alternately spaced on opposite sides of said center line such that at least two circumferentially successive tabs are located on opposite sides of said center line, said tabs having means for locating a bladder generally in-line with said center line and out of contact with said outer circumferential surface, wherein said means for locating a bladder includes an inner side wall which is shaped to fit an outer surface of the bladder.

22. A wheel hub for use with a pneumatic wheel, said hub comprising:

an inner surface forming an axial bore;

an outer circumferential surface spaced from said inner surface and having first and second edges and a center line evenly spaced from said first and second edges; and a plurality of positioning tabs located along the circumference of said outer surface and alternately spaced on opposite sides of said center line such that at least two circumferentially successive tabs are located on opposite sides of said center line, at least one of said plurality of positioning tabs comprises first and second spaced supports and a bridging member extending between said supports.

23. An in-line skate wheel, comprising:

a hub having an inner surface, an outer circumferential surface and a plurality of positioning tabs;

said inner surface forming a bore for receiving a wheel axle;

said outer circumferential surface being spaced from said inner surface and having first and second edges and a center line evenly spaced from said first and second edges;

said plurality of positioning tabs being located along the circumference of said outer circumferential surface and alternately spaced on opposite sides of said center line such that at least two successive tabs are located on opposite sides of said center line, at least one of said plurality of positioning tabs comprises first and second spaced supports and a bridging member extending between said supports;

a member received between and positioned by said positioning tabs out of contact with said outer circumferential surface; and a tire member completely surrounding at least a part of said member and bonded to said outer circumferential surface and positioning tabs of said hub by being molded thereto.

24. The in-line skate wheel according to claim 23 wherein said member includes at least one sheet of material circumferentially positioned about said hub.

25. The in-line skate wheel according to claim 23 wherein said member includes a bladder containing a fluid.

26. The in-line skate wheel according to claim 23 wherein each said support includes a contoured inside surface proximate said center line for positioning said member generally in-line with said center line.

27. The in-line skate wheel according to claim 26 wherein said contoured inside surface of each said support includes a first concave portion between a top of said support and a position spaced from said outer circumferential surface.

28. The in-line skate wheel according to claim 27 further comprising a second concave portion between said first concave portion and said outer circumferential surface.

29. The in-line skate wheel according to claim 28 further comprising a convex portion located between said first and second concave portions.

30. An in-line skate wheel comprising:

a hub having an inner surface, an outer circumferential surface and a plurality of positioning tabs;

said inner surface forming a bore for receiving a wheel axle;

said outer circumferential surface being spaced from said inner surface and having first and second edges and a center line evenly spaced from said first and second edges;

said plurality of positioning tabs being located along the circumference of said outer circumferential surface and alternately spaced on opposite sides of said center line such that at least two successive tabs are located on opposite sides of said center line, wherein said plurality of positioning tabs have a leading edge and a trailing edge, and said tabs are curved in the direction of said trailing edge;

a member received between and positioned by said positioning tabs out of contact with said outer circumferential surface; and a tire member completely surrounding at least a part of said member and bonded to said outer circumferential surface and positioning tabs of said hub by being molded thereto.

31. The in-line skate wheel according to claim 30 wherein said plurality of positioning tabs have a fin-like cross section in a plane parallel to said center line.

32. The in-line skate wheel according to claim 30 wherein said plurality of positioning tabs includes a contoured inside surface proximate said center line for positioning said member about said center line.

33. The in-line skate wheel according to claim 32 wherein said contoured inside surface of said tabs leaves a gap between said member and said contoured inside surface prior to the molding of said tire member to said hub.

34. The in-line skate wheel according to claim 33 wherein said contoured inside surface includes a concave portion positioned between a top edge of said positioning tab and said outer surface.

35. The in-line skater wheel according to claim 34 wherein said contoured inside surface further includes a vertical side wall between said concave portion and said outer circumferential surface.

36. The in-line skate wheel according to claim 35 wherein said contoured inside surface further includes a step groove between said vertical side wall and said concave portion.

37. The in-line skate wheel according to claim 36 wherein each of said plurality of positioning tabs has a leading edge and a trailing edge and said vertical side walls taper from said leading edge to said trailing edge.

38. The in-line skate wheel according to claim 30 wherein said member includes a bladder containing a fluid.

* * * * *